United States Patent [19]

White et al.

[11] Patent Number: 4,917,519

[45] Date of Patent: Apr. 17, 1990

[54] WRITING INSTRUMENTS WITH ROTATABLE WHEEL ACTUATOR

[75] Inventors: Robert White, Cholsey; Michael B. Seal, Henley-on-Thames, both of England

[73] Assignee: The Gillette Company, Boston, Mass.

[21] Appl. No.: 314,243

[22] Filed: Feb. 22, 1989

Related U.S. Application Data

[63] Continuation of Ser. No. 150,479, Feb. 8, 1988, abandoned, which is a continuation of Ser. No. 875,812, Jun. 18, 1986, abandoned.

[30] Foreign Application Priority Data

Jun. 21, 1985 [GB] United Kingdom ..... 8515830

[51] Int. Cl.[4] ..... B43K 7/12; B43K 24/02; B43K 24/06

[52] U.S. Cl. ..... 401/99; 401/109

[58] Field of Search ..... 401/99, 109, 30, 33, 401/112

[56] References Cited

U.S. PATENT DOCUMENTS 2,896,577 7/1959 Merryman et al. ..... 401/112

FOREIGN PATENT DOCUMENTS

| | | | |
|---|---|---|---|
| 1224178 | 9/1966 | Fed. Rep. of Germany | 401/33 |
| 1298910 | 7/1969 | Fed. Rep. of Germany | 401/99 |
| 2639299 | 3/1978 | Fed. Rep. of Germany | 401/99 |
| 561022 | 4/1957 | Italy | 401/109 |
| 52-20167 | 2/1977 | Japan | 401/30 |
| 1064734 | 4/1967 | United Kingdom . | |
| 2078622 | 1/1982 | United Kingdom | 401/30 |
| 2176749 | 1/1987 | United Kingdom | 401/99 |

*Primary Examiner*—Steven A. Bratlie
*Attorney, Agent, or Firm*—John P. Morley

[57] ABSTRACT

A writing instrument has a retraction mechanism of simple, inexpensive construction comprising a wheel (5) rotatably mounted on the barrel (1) and to which the trailing end of the writing unit (8) is connected by a pivot having its axis spaced from the rotation axis. In the writing position of the writing tip (9), the wheel abuts a stop defined either by the writing unit or the barrel to support the writing pressure exerted against the writing tip. The rear end of the reservoir tube (10) can be formed for direct snap-fit connection to the wheel, and the wheel is a snap-fit in the barrel.

11 Claims, 5 Drawing Sheets

WRITING INSTRUMENTS WITH ROTATABLE WHEEL ACTUATOR

This application is a continuation of application Ser. No. 150,479, filed Feb. 8, 1988, which is a continuation of application Ser. No. 875,812, filed June 18, 1986, both abandoned.

BACKGROUND OF THE INVENTION

1. The Field of the Invention

This invention relates to writing instruments, and in particular concerns a writing instrument including a retraction mechanism for advancing and retracting a writing tip relative to a barrel.

2. Description of the Prior Art

In the past, retraction mechanisms have tended to be of complicated construction and therefore expensive to manufacture. Consequently, pens incorporating such mechanisms have generally been designed for the ink reservoir and writing point to be replaced when the ink supply has been exhausted. Disposable pens intended to be discarded when the ink has run out have usually been provided with a removable cap to cover the writing point during periods of non-use, but such caps are inconvenient since they are easily misplaced or lost and can become detached inadvertently. Therefore, there is a need for a retraction mechanism which is of simple construction, inexpensive to produce yet effective and convenient in operation, so that it is suitable for use in a disposable pen.

SUMMARY OF THE INVENTION

With the above object in mind, the invention provides a writing instrument comprising a barrel with an axial bore, a writing tip carried by a reservoir received in the bore, and a member supported by the barrel for rotation about an axis transverse to the bore, the trailing end of the reservoir being coupled to said member by a pivot with an axis spaced from but parallel to said transverse axis whereby said member is rotatable to displace the reservoir longitudinally of the barrel for advancing and retracting the writing tips relative to the forward end of the barrel.

In accordance with one preferred feature of the invention, rotation of said member in a direction to advance the writing tip is limited by abutment with a stop, and the pivot is moved through a forwardmost position on rotating the member into abutment with the stop whereby writing pressure exerted on the advanced writing tip urges the member into firmer engagement with the stop. By this arrangement, the writing tip is firmly supported against unintentional retraction when adjusted to its writing position, this result being achieved by a simple abutment without requiring special interlocks or the like as frequently used in the prior art. The member may be adapted to abut the barrel or the reservoir, as will become clear from the description of some embodiments given below.

According to another preferred feature of the invention, the reservoir comprises a plastic tube and is formed at its trailing end to connect directly with the rotatable member. The end of the tube is preferably shaped by heating and pressing to define a flattened portion with a pair of opposed projections which snap into complementary depressions in the rotatable member. By forming the reservoir tube itself to define a direct pivotal attachment to the rotatable member, the need for an additional coupling component is avoided and the writing instrument can be assembled from three basic parts.

THE DRAWINGS

A better understanding of the invention will be had from the following detailed description of some pens embodying the invention, reference being made to the drawings, in which.

DESCRIPTION OF PREFERRED EMBODIMENTS

Figure 1:
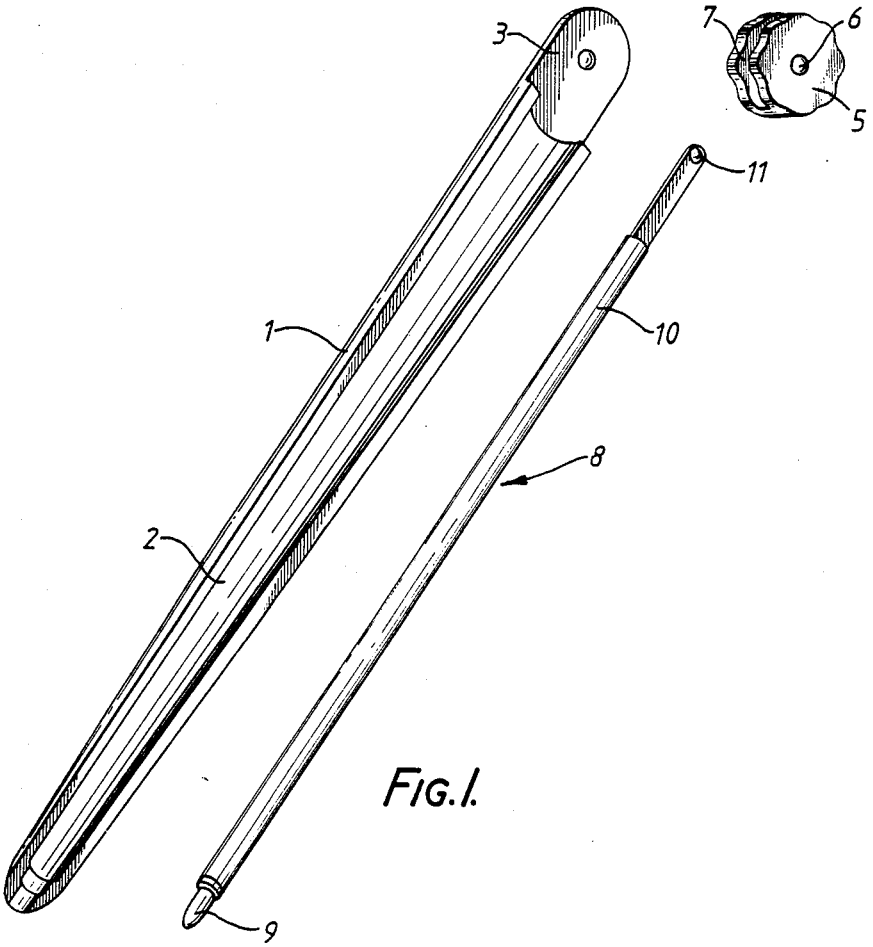
FIG. 1 is an exploded perspective view of the first embodiment, with the barrel shown in axial section.
Figure 2:
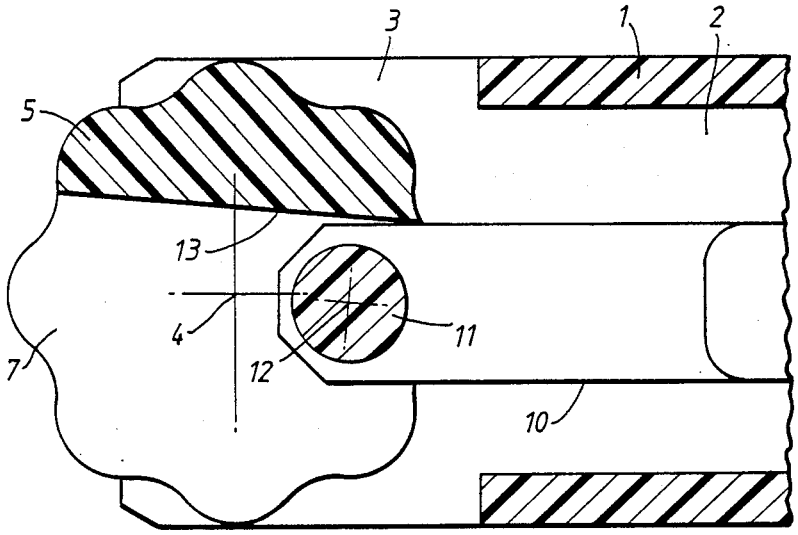
FIG. 2 is an enlarged longitudinal section of a rear end portion of the pen.
Figure 3:
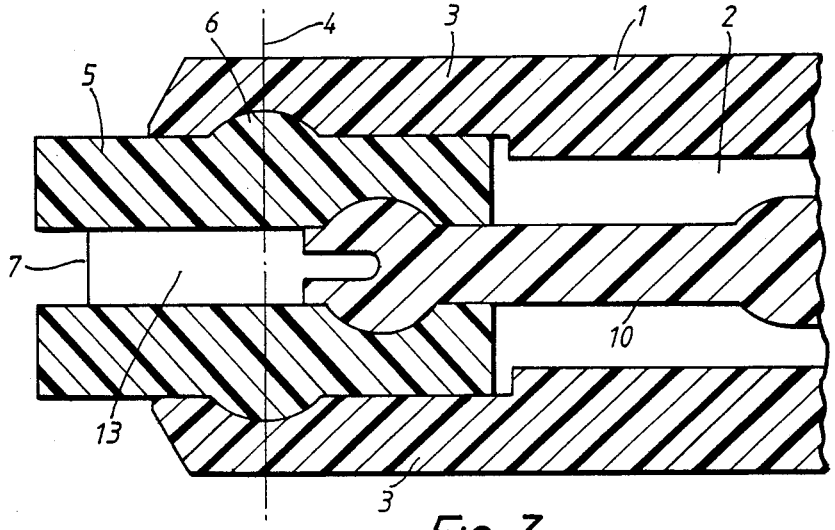
FIG. 3 is an axial section taken in a plane normal to that of FIG. 2.

The pen illustrated in FIGS. 1–3 has a moulded plastic barrel 1 with an axial through bore 2 which tapers towards the forward end of the barrel. A pair of integral, rearwardly projecting lugs 3 are provided at the rear end of the barrel and journalled between them for rotation about a transverse axis 4 is a wheel 5. As shown, projections 6 formed centrally on the opposite side of the wheel engage with a snap fit into complementary recesses formed in the lugs 3. However, it will be appreciated that the projections could be provided on the lugs and the depressions in the wheel. The periphery of the wheel is knurled to facilitate rotation by a finger or thumb. A transverse slot 7 in the wheel has a depth exceeding the wheel radius, as best seen in FIG. 2, and the trailing end of a writing unit 8 is adapted to engage in the slot. The writing unit includes a writing tip 9, such as a ball point or the like, and an ink reservoir 10 in the form of a plastic tube attached to the tip 9. As so far described the writing unit is of well known construction. According to the invention the rear end of the reservoir tube is adapted for direct connection to the wheel 5. An end portion of the tube which does not contain ink is, by heating and pressing, flattened and at the same time provided with a pair of opposed projections 11 which engage with a snap fit into complementary recesses formed in the opposite side walls of the slot 7 in wheel 5. In this way the end of the reservoir tube is pivoted to the wheel, the pivot axis 12 being spaced from but parallel to the wheel axis 4. Rotation of the wheel, due to the eccentricity of the pivot, causes the reservoir to be displaced longitudinally in the bore of the barrel for advancing the writing tip to a writing position protruding from the forward end of the barrel, and retracting the tip to a storage position withdrawn into the barrel. When the writing tip is moved to the writing position by clockwise rotation of the wheel as viewed in FIG. 2, the pivot axis moves through and slightly beyond a forwardmost or bottom dead center position, after which further rotation of the wheel is prevented by the bottom wall 13 of slot 7 coming into abutment with the reservoir 10. Writing pressure exerted on the writing tip 9 is transmitted to the wheel and acts to urge the wall 13 into firmer engagement with the reservoir, whereby the writing tip is supported firmly in the writing position. The wheel 5 is rotable in the anticlockwise direction through somewhat more than 180° from the FIG. 2 position to retract the writing tip.

Figure 4:
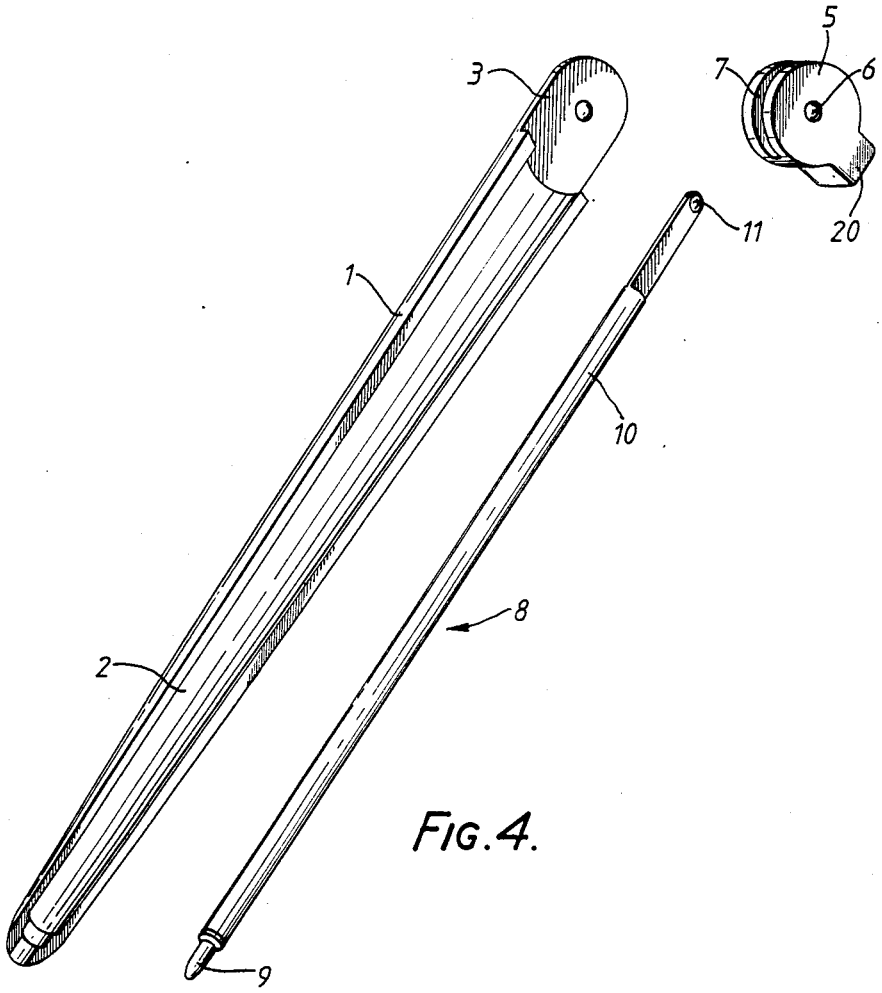
FIGS. 4, 5 and 6 are views corresponding to FIGS. 1, 2 and 3, respectively, of the second embodiment.
Figure 5:
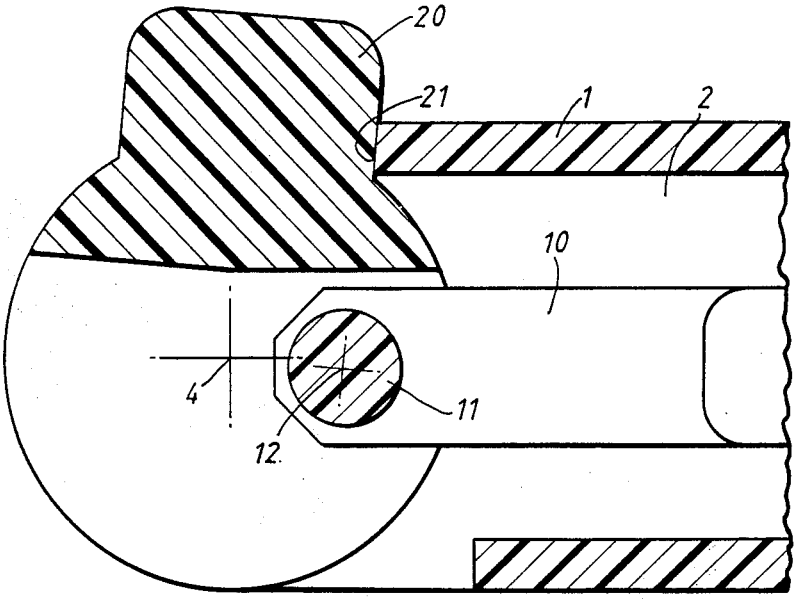
Figure 6:
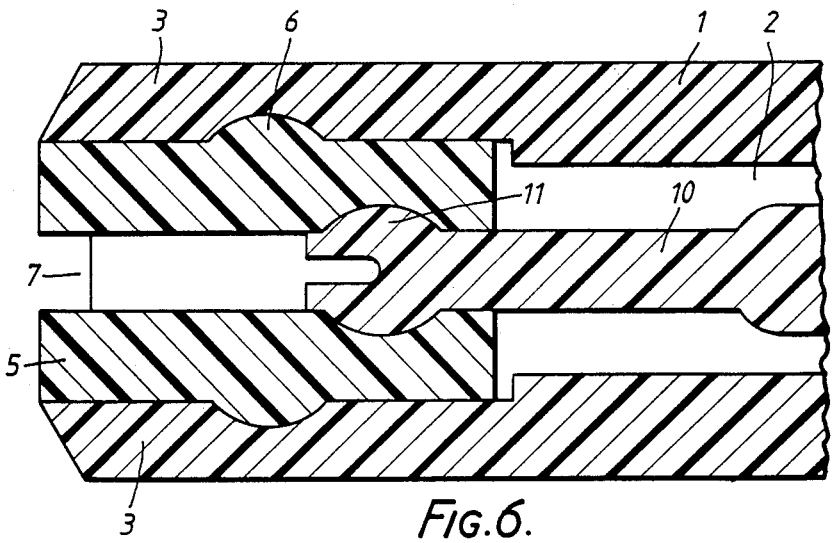

The pen of FIGS. 4–6 is generally similar to that of FIGS. 1–3 and only the main differences will be described. In this embodiment the wheel 5 is not knurled and is instead provided with a radial finger 20. Rotation of the wheel is limited by abutment of this finger with end walls of the barrel. Thus, in the writing position of the writing tip 9, the finger engages the end wall 21 of the barrel and serves to support the writing tip against the writing pressure exerted upon it. In this case, of course, the bottom wall of the slot is not required to engage the reservoir. In all other aspects the pen construction and operation are as described for the first embodiment.

The described pens are intended to be thrown away after the ink in the reservoir has been exhausted. Nevertheless, if required, a replacement writing unit 8 could be fitted by lifting the wheel out of the barrel and replacing the unit 8 before refitting the wheel.

Figure 7:
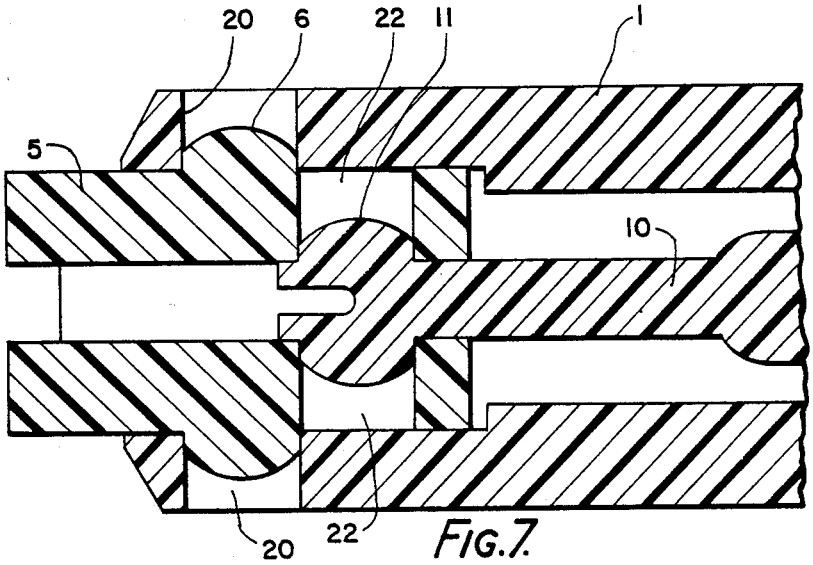
FIG. 7 is a view corresponding to FIG. 3 and illustrating a first modification.

According to the modification shown in FIG. 7, the barrel 1 is provided with through holes 20 instead of depressions for receiving the projections 6 of the wheel 5, and the projections include cylindrical portions which engage in the holes to provide more positive retention of the wheel in the barrel. Similarly, the wheel has cylindrical holes 22 for receiving the projections 11 on the reservoir tube, and these projections have cylindrical portions which engage in the holes. These modifications are also applicable to the pen of FIGS. 4 to 6 to ensure more secure connection between the wheel and both the barrel and the reservoir tube.

Although the writing pressure is supported by the abutment of the wheel with either the writing unit (FIGS. 1–3) or the barrel (FIGS. 4–6), it may be preferable to include a detent for retaining the wheel against unwanted rotation. Thus, as shown in FIG. 8*a* a pocket clip 25 integral with the barrel includes a resilient extension 26 with an inwardly directed protrusion 27 arranged to cooperate with the recesses in the radially undulating periphery of the wheel.

Figure 9:
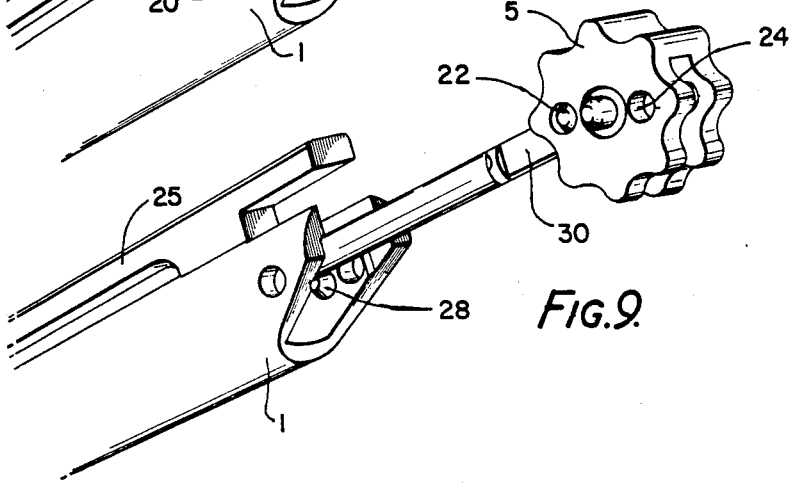

A different detent is illustrated in FIG. 9 and consists of opposed protrusions 28 within the barrel which engages in the holes 22 when the writing tip is extended and engage holes 24 when the tip is retracted.

Figure 8:
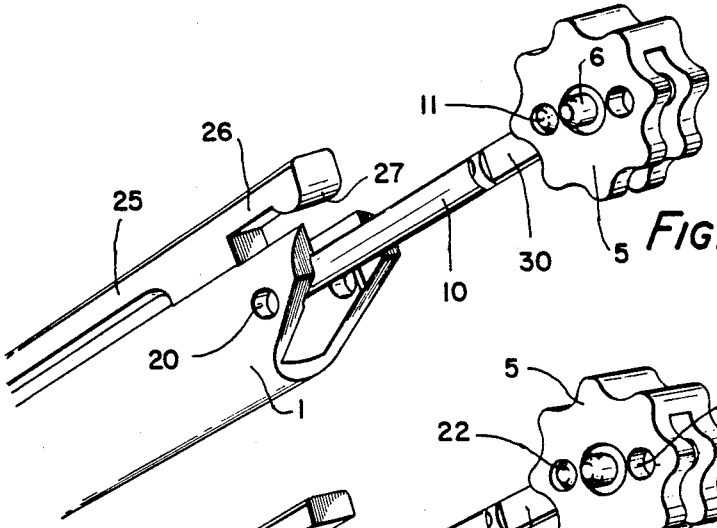
FIGS. 8 and 9 are exploded, perspective views of the rear ends of two pens and showing some further modifications.

In the pens of FIGS. 8 and 9 a connection piece 30 fixed to the rear end of the reservoir tube 10 is used to connect the tube to the wheel 5. However, the tube could be formed for direct connection as in the previous embodiments.

We claim:

1. A writing instrument comprising a barrrel with an axial bore and having an end wall, a writing tip carried by a single reservoir received in the bore and a rotatable wheel member including a transverse slot extending inwardly from the periphery of the wheel to a depth exceeding the radius of the wheel member and including opposed side walls and a bottom wall, said wheel member being supported by the barrel about an axis transverse to the bore, the trailing end of the reservoir being positioned in said slot in engagement with each of the opposed side walls of the slot to provide a pivot having an axis spaced apart from but parallel to said axis transverse to the bore and which is movable through a forwardmost position so that rotation of said wheel member in one direction moves the pivot axis through the forwardmost position to longitudinally displace the reservoir in the barrel to thereby advance the writing tip relative to the forward end of the barrel to a writing position and rotation of said wheel member in an opposite direction longitudinally displaces the reservoir in the barrel to retract the writing tip from the writing position to a retracted position and where said wheel member includes a radial projection providing means for abutment of said wheel member against a stop defined by the end wall of the barrel on movement of the pivot axis through the forwardmost position so that when the tip is advanced to the writing position, pressure on the advanced writing tip urges the abutment means into firmer engagement with the stop.

2. A writing instrument of claim 1 where detent means are provided for retaining the wheel member against unwanted displacement.

3. A writing instrument of claim 2 where the detent means comprise a projection on the barrel engageable with recess means provided on the wheel.

4. A writing instrument of claim 1 where the opposed side walls of the slot have a pair of opposed recess means and the trailing end of the reservoir carries a pair of opposed projections which are arranged and adapted to engage said recess means with a snap fit.

5. A writing instrument of claim 1 where the wheel member has a pair of opposed projections arranged and adapted to engage opposed recesses carried by the barrel with a snap fit.

6. A writing instrument comprising a barrel with an axial bore and having an end wall, a writing tip carried by a single reservoir received in the bore and a rotatable wheel member including a transverse slot extending inwardly from the periphery of the wheel to a depth exceeding the radius of the wheel member and including opposed side walls and a bottom wall, said wheel member being supported by the barrel about an axis transverse to the bore, the trailing end of the reservoir being positioned in said slot in engagement with each of the opposed side walls of the slot to provide a pivot having an axis spaced apart from but parallel to said axis transverse to the bore and which is movable through a forwardmost position so that rotation of said wheel member in one direction moves the pivot axis through the forwardmost position to longitudinally displace the reservoir in the barrel to thereby advance the writing tip relative to the forward end of the barrel to a writing position and rotation of said wheel member in an opposite direction longitudinally displaces the reservoir in the barrel to retract the writing tip from the writing position to a retracted position and where the bottom wall of the slot of said wheel member provides means for abutment of said wheel member against a stop defined by the reservoir on movement of the pivot axis through the forwardmost position so that when the tip is advanced to the writing position, pressure on the advanced writing tip urges the abutment means into firmer engagement with the stop.

7. A writing instrument of claim 6, where detent means are provided for retaining the wheel member against unwanted displacement.

8. A writing instrument of claim 7 where the detent means comprise a projection on the barrel engageable with recess means provided on the wheel.

9. A writing instrument of claim 6 where the opposed side walls of the slot have a pair of opposed recess means and the trailing end of the reservoir carries a pair of opposed projections which are arranged and adapted to engage said recess means with a snap fit.

10. A writing instrument of claim 6 where the wheel member has a pair of opposed projections arranged and adapted to engage opposed recesses carried by the barrel with a snap fit.

11. A writing instrument comprising a barrel with an axial bore and having an end wall, a writing tip carried by a single reservoir received in the bore and a rotatable wheel member including a transverse slot extending inwardly from the periphery of the wheel to a depth exceeding the radius of the wheel member and including opposed side walls and a bottom wall, said wheel member being supported by the barrel about an axis transverse to the bore, the trailing end of the reservoir being positioned in said slot in engagement with each of the opposed side walls of the slot to provide a pivot having an axis spaced apart from but parallel to said axis transverse to the bore and which is moveable through a forwardmost position so that rotation of said wheel member in one direction moves the pivot axis through the forwardmost position to longitudinally displace the reservoir in the barrel to thereby advance the writing tip relative to the forward end of the barrel to a writing position and rotation of said wheel member in an opposite direction longitudinally displaces the reservoir in the barrel to retract the writing tip from the writing position to a retracted position and where said wheel member includes means for abutment of said wheel member against a stop defined by the reservoir or the barrel on movement of the pivot axis through the forwardmost position so that when the tip is advanced to the writing position, pressure on the advanced writing tip urges the abutment means into firmer engagement with the stop.

* * * * *